US005882184A

United States Patent [19]

Feldermann

[11] Patent Number: 5,882,184

[45] Date of Patent: Mar. 16, 1999

[54] LOW EMISSION SWIRL BURNER

[75] Inventor: Christian J. Feldermann, Sheffield, England

[73] Assignee: The BOC Group plc, Windlesham, England

[21] Appl. No.: 905,378

[22] Filed: Aug. 4, 1997

[30] Foreign Application Priority Data

Aug. 5, 1996 [GB] United Kingdom ..... 9616448

[51] Int. Cl.[6] ..... F23D 14/84

[52] U.S. Cl. ..... 431/9; 431/10; 431/182; 431/187; 431/186; 239/424.5; 239/433

[58] Field of Search ..... 431/8, 9, 10, 12, 431/181, 182, 190, 187, 186, 189, 159, 353, 115, 116; 239/406, 424.5, 433

[56] References Cited

U.S. PATENT DOCUMENTS

| | | | |
|---|---|---|---|
| 3,285,240 | 11/1966 | Schmidt . | |
| 3,685,740 | 8/1972 | Sherpherd | 239/430 |
| 4,203,717 | 5/1980 | Facco et al. | 431/189 |
| 4,475,885 | 10/1984 | Finke | 431/182 |
| 4,797,087 | 1/1989 | Gitman | 431/10 |
| 5,241,949 | 9/1993 | Collier | 431/353 |
| 5,393,220 | 2/1995 | Couwels et al. | 431/10 |
| 5,542,839 | 8/1996 | Kelly | 431/10 |

*Primary Examiner*—Carl D. Price

*Attorney, Agent, or Firm*—David M. Rosenblum; Salvatore P. Pace

[57] ABSTRACT

A burner is provided with a central fuel outlet and a plurality of oxygen outlets shaped and positioned for creating a converging, rotating stream of oxygen which intersects with any fuel issuing from the fuel outlet. Such oxygen/fuel interaction results in two zones of combustion and a recirculation effect which assists in the complete or substantially complete combustion of undesirable exhaust gas components.

16 Claims, 5 Drawing Sheets

LOW EMISSION SWIRL BURNER

BACKGROUND OF THE INVENTION

The present invention relates to a burner and relates particularly, but not exclusively, to a burner having low $NO_x$ emission and one employing a gas swirling technique to assist with complete or substantially complete combustion.

U.S. Pat. No. 3,685,740 discloses an oxygen-fuel burner of the rocket burner type comprising a cylindrical combustion chamber having an open discharge end and a burner plate with separate oxygen and fuel ports constituting the opposite end of the chamber; the projected longitudinal axis of the oxygen ports extending in converging directions towards the longitudinal axis of the chamber but being in off-set, non-intersecting relation thereto, so that points on the respective axes that most closely approach the chamber axes define a transversely positioned plane between the burner plate and the chamber exhaust; the projected longitudinal axes of the fuel ports being substantially parallel to the chamber axes for mixing of oxygen and fuel at and beyond the plane of closest approach, and means for adjusting the longitudinal position of the burner plates on the chamber axes and thereby locating the plane of closest approach in relation to the chamber exhaust for determining the pattern of the burner discharge flame. Such a burner also includes a cooling water jacket which extends towards the tip of the burner thereby to cool said tip during operation of the burner. Whilst this burner is capable of producing a number of different flame patterns, these patterns tend to be turbulent and are therefore not suitable for certain applications. It is also noted that this burner is designed for complete mixing of the oxygen / fuel so that hot fully combusted flame gases will leave the burner. Consequently, the tip of the burner will require cooling and hence the overall burner efficiency will be reduced as part of the combustion will be lost to the cooling fluid in the cooling jacket. Additionally, this burner is comparatively noisy because of the high mixing rate and the fact that any noise will be amplified in the burner body.

SUMMARY OF THE INVENTION

It is an object of the present invention to provide a burner which reduces and possibly eliminates the problems associated with the above-mentioned arrangement.

Accordingly, the present invention provides an oxygen-fuel burner having an outer jacket comprising a first inlet end, a second outlet end for combustion flame discharge and a longitudinal axis X; fuel supply means, for introducing a stream of fuel into the inlet end and directing it towards the outlet end; oxygen supply means, for introducing oxygen into the inlet end and for directing it towards the outlet end; in which the fuel supply means comprises a substantially central outlet having a diverging conical inner surface over which the fuel is passed as it issues therefrom and the oxygen supply means comprises a plurality of oxygen outlets circumferentially spaced around the fuel supply means and angled radially inwards towards the outlet end and skewed relative to axis X thereby to produce a swirling converging cone of oxygen which intersects the fuel stream in a first upstream zone thereof.

By combining the aerodynamic controlled delay of flow mixing and the laminarisation of low with the internal recirculation (ie within the flame) of combustion gases and oxidants, such a burner has been found to produce low CO, $NO_x$ and soot emissions (eg $NO_x$ levels under about 500 $mg/m^3$ at a furnace temperature of about 1600° C. and up to about 2.5 MW power) and the conical nozzle design reduces the amount of noise from the 120 dB of the prior art to about 87 dB at about 1.5 MW. It is very easy rapidly to change the shape of the flame emitted by the burner and, due to the reduced soot formation using the burner (because combustion gases and oxidant are internally recirculated within the flame due to the effect of the swirl, soot formed is burned without residuals in the latter part of the flame) a very luminous flame is produced. The burner generates a flame having two regions of combustion: the first, adjacent the fuel outlet, being a fuel-rich zone and a second, later zone where the main combustion takes place and where the majority of the heat is generated. This distancing of the main combustion from the burner prevents overheating of the burner and adjacent refractories, obviating the need for any water-cooling thereof.

Preferably, the oxygen supply outlets are angled radially inwardly at an angle $\alpha$ of between about 5 to about 10 degrees relative to axis X.

Preferably, the oxygen supply outlets are skewed at an angle of $\Theta$ of between about 20 to about 30 degrees relative to axis X.

Advantageously, the fuel supply means diverges at an angle $\phi$ of between about 30 to about 40 degrees relative to axis X.

Preferably, angle $\phi$ is between about 30 and about 35 degrees.

In a particularly advantageous arrangement, the burner includes means for varying the axial position of the fuel and oxygen outlets within the combustion chamber, thereby to vary the discharge pattern of the burner.

Conveniently, the fuel and oxygen supply means are mounted in a burner plate within the combustion chamber and said burner plate is axially displaceable along axis X thereby to vary the axial to position of the fuel and oxygen outlets within the combustion chamber.

In certain applications it is advantageous to provide additional air, or oxygen-enriched air, for combustion. This is preferably achieved by providing a plurality of air outlets circumferentially spaced around the oxygen outlets, the air outlets being configured so as to direct a flow of air radially inwardly relative to axis X and skewed relative thereto. The air outlets are preferably skewed in the same direction as the oxygen outlets. In a particularly beneficial arrangement, the burner includes fuel and oxygen injection means for injecting the fuel and oxygen into the combustion chamber at a velocity ratio of substantially 2:1.

The fuel outlet may comprise a fuel oil outlet or fuel gas outlet and the oxygen supply means may supply oxygen, air, or oxygen-enriched air.

The present invention also provides a method of operating a burner as described above including the steps of:

(a) causing fuel to issue from the fuel supply means in a manner which creates a relatively high velocity stream of fuel having a laminar or substantially laminar flow and directing the same for discharge from the second end of the combustion chamber;

(b) causing oxygen to issue from the oxygen supply means in a manner which creates a relatively low velocity stream of oxygen which converges on and rotates around the longitudinal axis X thereby to intersect with the fuel stream in a first upstream zone thereof and create a fuel rich region threat and introducing any remaining oxygen into a downstream zone of the fuel flow in a manner which creates a fuel lean region thereof.

BRIEF DESCRIPTION OF THE DRAWINGS

The present invention will now be more particularly described by way of example only with reference to the following drawings, in which.

DETAILED DESCRIPTION

Figure 1:
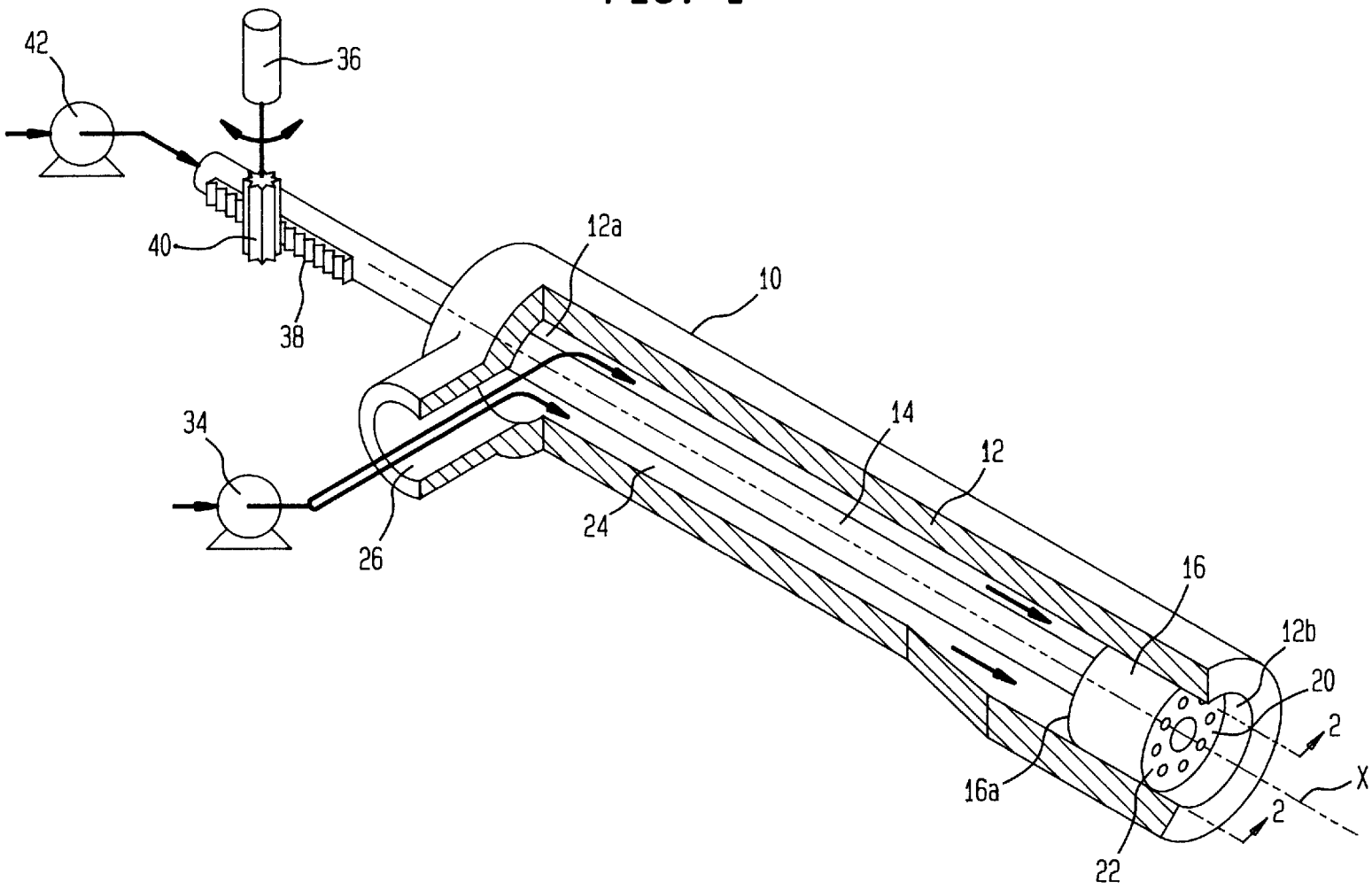
FIG. 1 is a perspective view, partially in section, of an oxygen-fuel burner embodying the invention.

The oxygen-fuel burner 10 shown by way of example in FIG. 1, comprises a tubular or cylindrical jacket 12 having a first inlet end 12*a*, a second outlet end 12*b* for combustion flame discharge and a longitudinal axis X and a central fuel supply pipe 14 extending between the inlet end 12*a* and outlet end 12*b* at which point it is coupled to a burner block (or plate) 16 best seen in FIGS. 2 to 6. The fuel supply pipe 14 terminates in a substantially central outlet 18 positioned on axis X and having a generally diverging conical inner surface 20 over which the fuel is passed as it issues therefrom. Also provided on the burner block are a plurality of oxygen outlets 22 circumferentially spaced around the fuel supply outlet 18 and angled radially inwards towards the outlet end 12*b* and skewed relative to axis X thereby to produce a swirling converging cone of oxygen which intersects the fuel stream in a first upstream zone Z1. Referring now once again to FIG. 1, it will be noted that the oxygen supply means further comprises the passage 24 formed between housing 12 and the fuel supply duct 14, oxygen being supplied via inlet 26 and is then directed along duct 24 such that it confronts a rear surface 16*a* of burner block 16 at which point the oxygen is passed into the plurality of oxygen supply outlets 22 which each terminate at a point positioned within conical surface 20.

Figure 2:
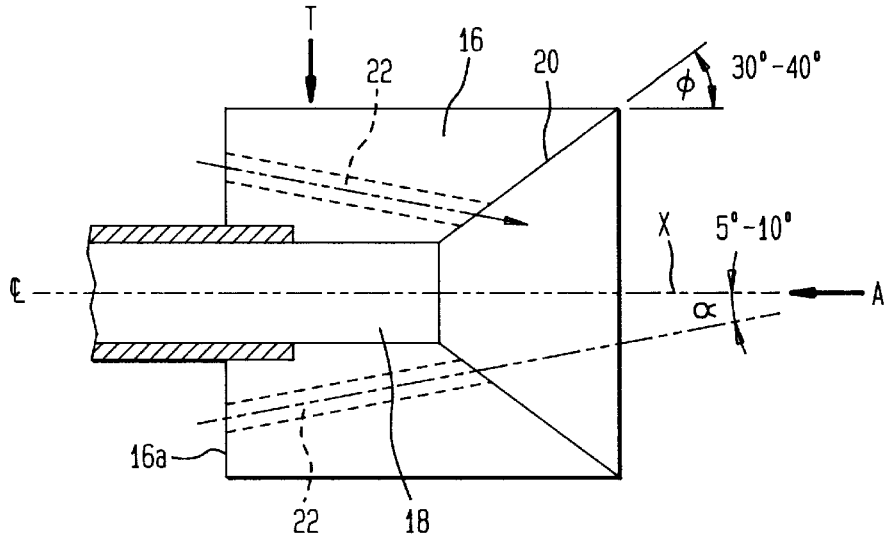
FIG. 2 is a cross sectional view of the burner block illustrated in FIG. 1 and illustrates the flow pattern associated therewith.

From FIG. 2 it will be seen that the oxygen outlets 22 are each angled radially inwardly at an angle $\alpha$ of between about 5 to about 10 degrees relative to axis X which results in any oxygen flow being directed radially inwardly such that it intersects with the flow of fuel exiting outlet 18. From the plan view of FIG. 3 it will be seen that each oxygen outlet 22 is also skewed at an angle $\Theta$ of between about 20 and about 30 degrees relative to axis X. FIG. 4 illustrates in hidden detail the path of the oxygen supply inlets 22 as they progress from face 16*a* to surface 20. The angles of the oxygen outlets 22, the diverging conical shape of the nozzle 20 and the velocity ratios between the oxygen and fuel are very important and dictate the amount of emissions and the flame shape.

Referring now more particularly to FIGS. 2 to 6 it will be appreciated that the divergence of surfaces 20 at between about 30° and about 40° (preferably between about 30° and about 35°) will allow the fuel issuing from outlet 18 to extend in a smooth manner and create a comparatively long, narrow, straight stream having a substantially laminar flow. This is in stark contrast with many of the prior art arrangements in which the fuel is introduced in a manner which is specifically aimed at creating a turbulent flow regime. The plurality of oxygen ducts 22 being positioned to direct an oxygen stream radially inwards at an angle $\alpha$ of between about 5° to about 10° a relative to axis X is such as to cause delayed mixing of the oxygen into the fuel flow such that zone Z1 is maintained in a substantially fuel rich regime whilst zone Z2 is maintained as a fuel lean region. This arrangement has the advantage of delaying the creation of the luminous region which starts at the position approximately 300 mm to 500 mm away from the burner, thus preventing overheating of the burner and any refractory material. Consequently, this design is able to maintain the initial flame temperature at under about 1200° C. and hence water cooling of the burner is not necessary. Temperatures of up to about 1650° C. can be accommodated if alloys such as INCO ALLOY, CuproNickel or Monel 400 are used or water cooling is provided. The fuel rich zone Z1 extends for approximately 300 mm to 500 mm length and terminates at the start of the second, somewhat larger, zone Z2 where the main combustion takes place. The extent of the second zone Z2 can be controlled by varying the angle $\alpha$ and the retraction of the nozzle or burner block 16 within jacket, or casing, 12. Whilst it will be appreciated that angle $\alpha$ will generally be set for any particular burner design, the position of burner block 16 can be varied along axis X by actuation of motor 36 (FIG. 1) which in turn, through rack and pinion gear 38, 40, moves fuel supply duct 14 and burner block 16 axially along axis X. The more the burner block 16 is retracted, the greater the effect that outlet end 12*b* will have on the flame shape with the swirling effect being reduced as retraction increases. Such swirl reduction results in associated flame length and recirculation changes and, hence, the flame pattern can be altered to suit a particular customer requirement. Clearly, if burner block 16 is positioned such that it terminates flush with outlet end 12*b* there will be little, if any interference therefrom and the flame shape will be dictated largely by the shape, position and angles of the fuel and oxygen outlets themselves.

Figure 3:
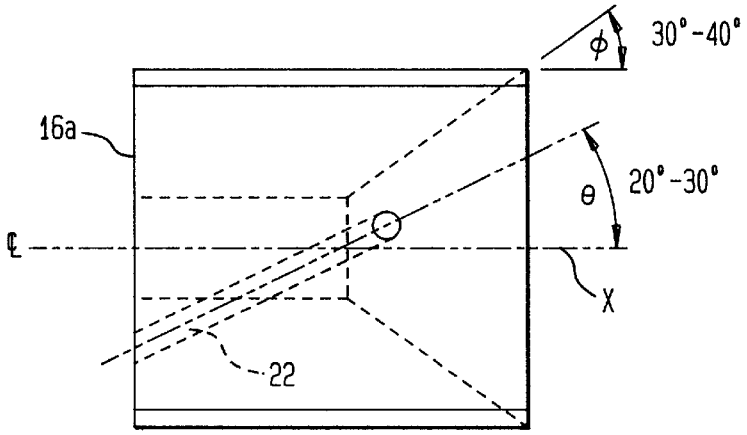
FIG. 3 is a plan view of the burner block taken in the direction of arrow T in FIG. 2.
Figure 4:
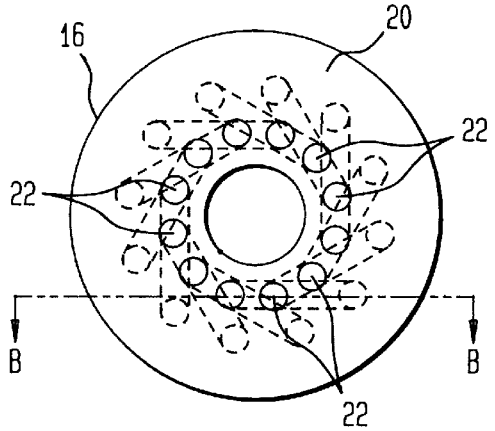
FIG. 4 is an end elevation of the burner block taken in the direction of arrow A of FIG. 2.
Figure 5:
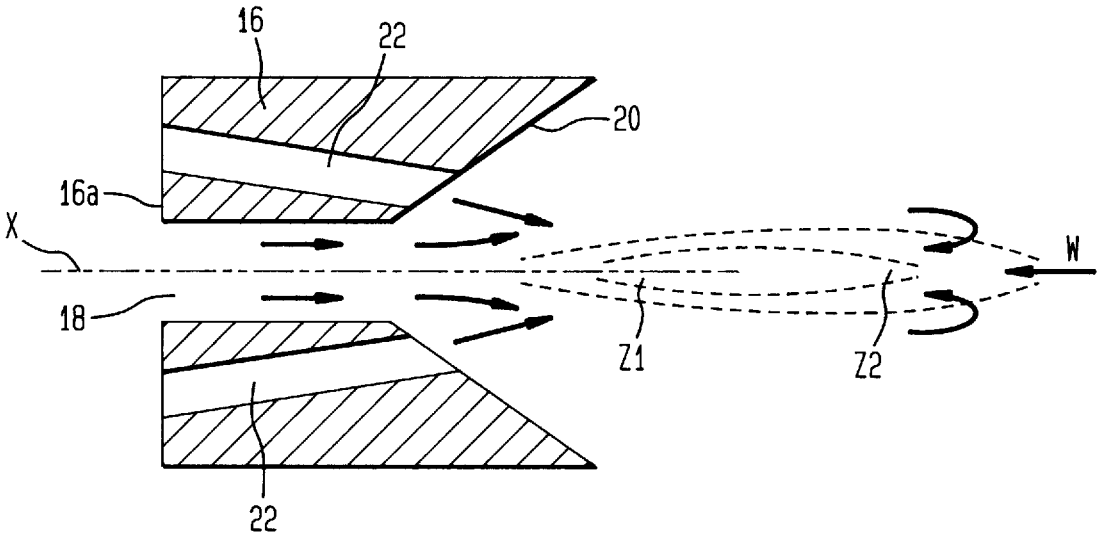
FIG. 5 is a further cross-sectional view of the burner block and illustrates the flow pattern associated therewith.
Figure 6:
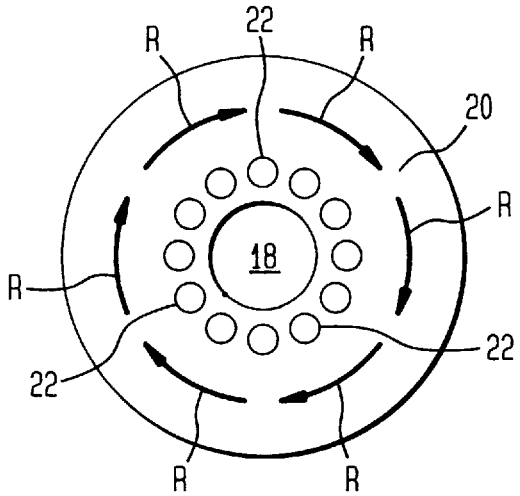
FIG. 6 is an end elevation of the burner block taken in the direction of arrow W in FIG. 5.

Referring now more specifically to FIGS. 3 and 4, it will be appreciated that the oxygen outlets 22 are also skewed at an angle $\Theta$ relative to longitudinal axis X thus providing a degree of swirl in the oxygen stream which then rotates in the direction of arrow R around the central fuel flow. An angle $\Theta$ of between about 20° and about 30°, preferably between about 20° and about 25°, imparts sufficient swirl to cause a recirculation effect to be generated in the combustion zone Z2 such that any remaining undesirable combustion products are recirculated and mixed with any remaining $O_2$ for complete or substantially complete combustion thereof, and consequently there is a significant reduction in $NO_x$, CO and soot before the flame exits zone Z2.

Figure 7:
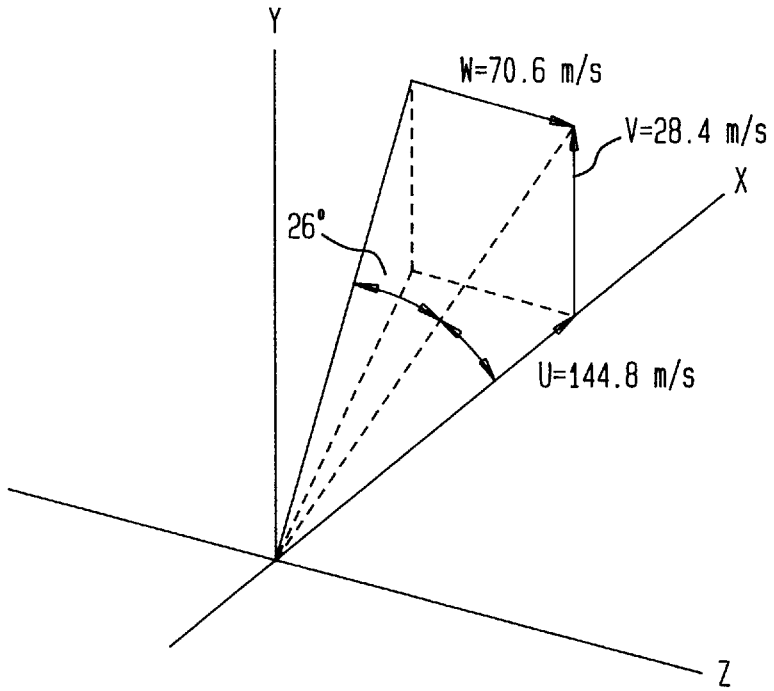
FIG. 7 is a graph of the oxygen velocity as it exits the outlets.
Figure 8:
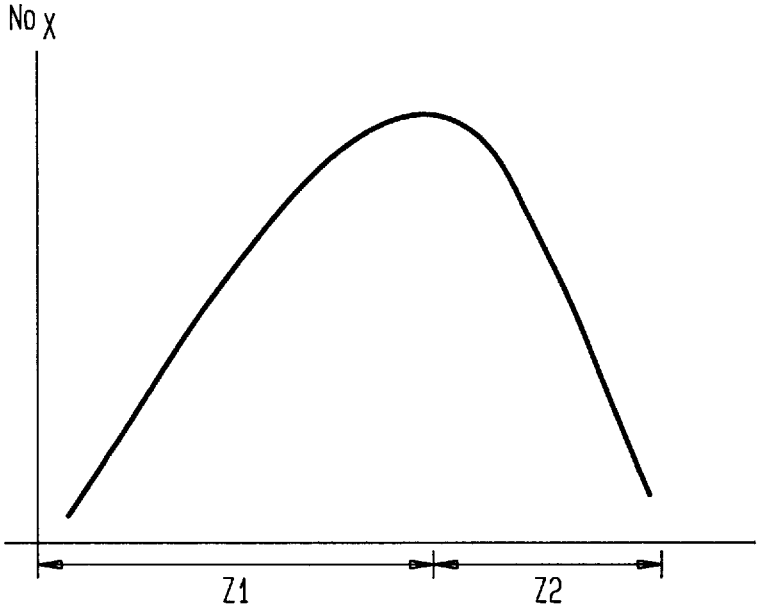
FIG. 8 is a graph of combustion flame $NO_x$ concentration.

Referring now briefly once again to FIG. 1, an actuator in the form of motor 36 and rack and pinion arrangements 38, 40 are provided at a distal end of fuel duct 14 and operable to cause said duct and burner plate 16 to move axially along axis X thereby to vary the axial position of the fuel and oxygen outlets 18, 22 within the combustion chamber and, hence, vary the discharge pattern of the burner itself, as is known in the art. Pumps 34 and 42 of FIG. 1 act to deliver the fuel and oxygen into the combustion chamber at a required flow rate and a ratio of substantially 2:1 in order to assist in the generation of the necessary flow requirements. FIG. 7 illustrates a typical velocity profile of the oxygen as it passes out of the outlets 22 for a velocity of about 163.6 m/s within the outlet (the velocity of the oxygen in the orthogonal x, y, z directions being denoted by references u, v, w respectively). Fuel flow is in proportion therewith. FIG. 8 provides a diagrammatic representation of the $NO_x$ distribution in zone Z1 and zone Z2 from which it will be appreciated that $NO_x$ can be expected to rise as one progresses through zone Z1 and then fall as one progresses through zone Z2.

In operation, the present burner reduces the formation of nitrogen oxides by combining delayed mixing of fuel/oxygen with laminarisation of flow and an internal recirculation. Such methods result in the generation of two regions Z1, Z2 of combustion, first a very fuel rich zone, of about 300 mm to about 500 mm length, second a larger zone where the main combustion takes place. Both zones have their own characteristics with the first, Z1, being of very low temperature and low luminosity, thus preventing the formation of $NO_x$ and the overheating of the burner and/or any refractory material adjacent thereto whilst the adjacent zone Z2 is somewhat hotter. As described above, the extent of the second zone Z2 can be controlled by the angle of the oxygen ports and the retraction of the nozzle burner block 16 within the jacket 12. Zone Z2 is very luminous, the main part of the fuel being completely combusted due, at least in part, to a recirculation effect created by the oxygen swirling around the fuel stream. Consequently $NO_x$ generation is thus prevented and soot formed to increase the luminosity is burned without residuals. $NO_x$ levels of under about 500 mg/m3 at a furnace temperature of about 1400° C. and up to about 1.5 MW power have been achieved, with similar $NO_x$ levels at a furnace temperature of about 1600° C. and about 2.5 MW power. Additionally, this design of nozzle is capable of reducing noise levels from the 120 dB of the prior art to about a 94 dB for a burner output of about 1.5 MW.

The radial angle $\alpha$ of the oxygen outlets 22 provides the characteristic delayed mixing and transparent blue, initially low temperature part of the flame and the skew angle $\Theta$ provides the characteristic swirl number and the respective internal recirculation with the sooty flame. Variation of angle ax affects and thus provides control over flame length and $NO_x$ formation, whilst variation of angle $\Theta$ affects flame width, luminosity and $NO_x$ formation. The fuel outlet 18 is large in diameter relative to conventional burners, and provides the desired 2:1 velocity ratio between the oxygen and the fuel velocities. The cone angle $\phi$ of between about 30° and about 40°, preferably between about 30° and about 35°, provides complete stabilisation of the flame for a wide range of flows (ie wide "turndown") as well as the reduction in operational noise levels.

Figure 9A:
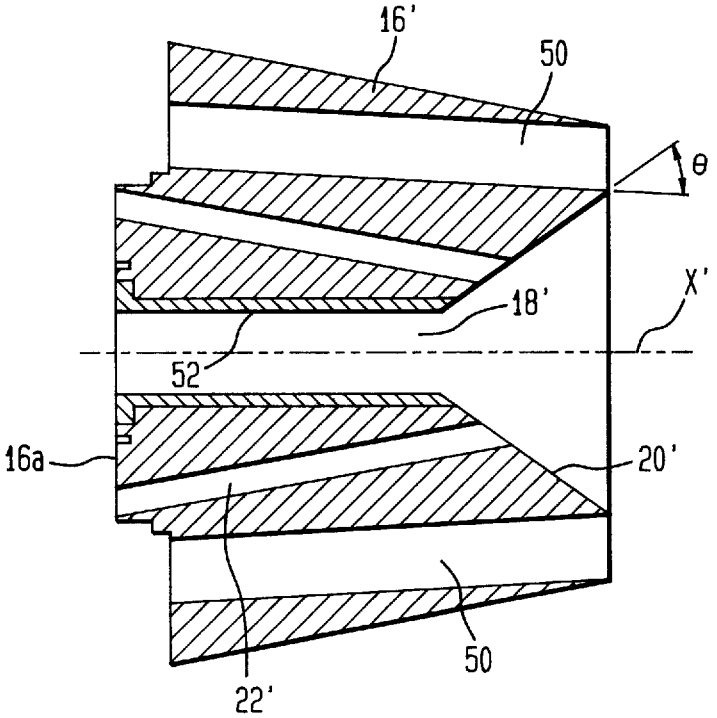
FIG. 9*a* is a cross-sectional view of an alternative embodiment of a burner block.
Figure 9B:
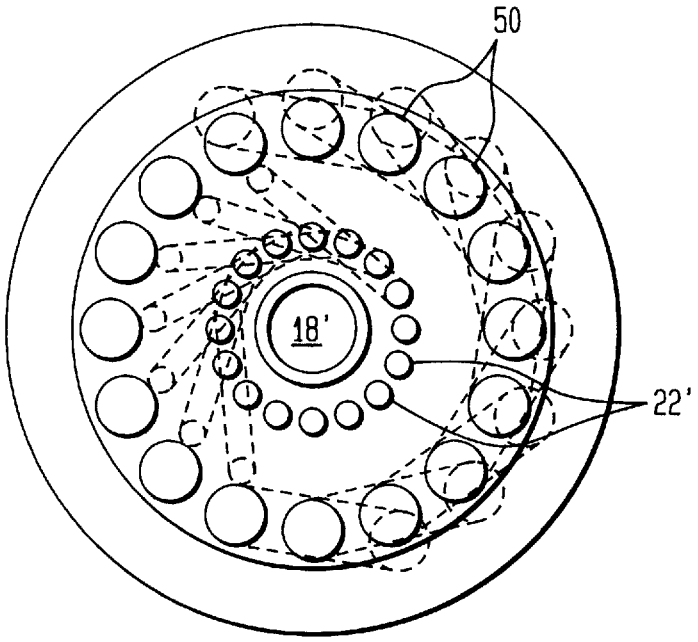
FIG. 9*b* is an end elevation view of the burner block of FIG. 9*a*.

Referring now to FIGS. 9*a* and 9*b*, in which elements identical to those already described are denoted by a prime, a further embodiment of the invention is illustrated.

Circumferentially spaced around the oxygen outlets 22' is a plurality of air outlets 50 for supplying air or oxygen-enriched air to the combustion process. Air outlets 50 are angled inwardly relative to axis X, but at an angle somewhat greater than $\alpha$, so as to converge towards the flame towards the intersection of the first and second zones Z1 and Z2 (see FIG. 5). Air outlets 50 are also skewed in the same direction as oxygen outlets 22' (see FIG. 9*b*) so as to add to the advantageous swirl effect produced by the skewing of the oxygen outlets 22'. It may equally be advantageous, in promoting further turbulence, to skew the air outlets 50 in the opposite direction to the skew of the oxygen outlets 22' (not shown).

In the embodiment of FIGS. 9*a* and 9*b*, the fuel supply means comprises a cap assembly 52 (the front end of which provides the first, innermost part of the divergent conical surface 20') which is coaxial with axis X' and releasably mounted within burner block 16'. This is a particularly advantageous arrangement as it permits rapid replacement of cap assembly 52, for maintenance or repair or to change the angle of the first divergent conical surface which may be desirable when changing the type of fuel supplied to the burner.

As is known in the art, means are provided for varying the flows of fuel, oxygen and air into, and hence out of, the burner in order finely to adjust the combustion process for a particular application.

In addition to other advantages mentioned above, a burner in accordance with the invention is suitable for use in the glass and metal industries, and for thermal treatment generally; it can be used in cylindrical (rotary) furnaces or in box-shaped furnaces.

I claim:

1. A method of operating a burner as claimed including the steps of:

(a) causing fuel to issue from a fuel supply in a manner that creates a relatively high velocity stream of fuel having a laminar flow and directing the laminar flow for discharge from an end of a combustion chamber; and (b) causing oxygen to issue from an oxygen supply in a manner which creates a relatively low velocity stream of oxygen which converges on and rotates around a longitudinal axis X thereby to intersect with the fuel stream in a first upstream zone thereof and create a fuel rich region threat and introducing remaining oxygen into a downstream zone of the fuel flow in a manner which creates a fuel lean region thereof.

2. An oxygen-fuel burner comprising:

an outer jacket having a first inlet end, a second outlet end for combustion flame discharge, and a longitudinal axis X;

fuel supply means for introducing a stream of fuel into the first inlet end and directing it towards the second outlet end; and oxygen supply means for introducing oxygen into the inlet end and for directing it towards the outlet end;

the fuel supply means comprising a substantially central outlet having a diverging, smooth, unbroken conical inner surface over which fuel passes as it issues therefrom to promote laminar flow of the fuel;

the oxygen supply means comprising a plurality of oxygen outlets circumferentially spaced around the fuel supply means and angled radially inwards towards the second outlet end and skewed relative to axis X thereby to produce a swirling converging cone of oxygen which intersects the fuel stream in a first upstream zone thereof.

3. The oxygen-fuel burner as claimed in claim 2 in which the oxygen supply outlets are angled radially inwards at an angle $\alpha$ of between about 5 to about 10 degrees relative to axis X.

4. The oxygen-fuel burner as claimed in claim 2 in which the oxygen supply outlets are skewed at an angle $\theta$ of between about 20 to about 30 degrees relative to axis X.

5. The oxygen-fuel burner as claimed in claim 2 in which the fuel supply means diverges at an angle $\phi$ of between about 30 to about 40 degrees relative to axis X.

6. The oxygen-fuel burner as claimed in claim 5 in which angle $\phi$ is between about 30 and about 35 degrees.

7. The oxygen-fuel burner as claimed in claim 2 further including means for varying the axial position of the fuel and oxygen outlets within the combustion chamber, thereby to vary the discharge pattern of the burner.

8. The oxygen-fuel burner as claimed in claim 2 in which the fuel and oxygen supply means are mounted in a burner block within the combustion chamber and said burner block is axially displaceable along axis X thereby to vary the axial to position of the fuel and oxygen outlets within the combustion chamber.

9. The oxygen-fuel burner as claimed in claim 8 wherein the central fuel outlet and at least the innermost portion of the divergent conical surface form part of a unitary element which is rcleasably mountable to the burner block.

10. The oxygen-fuel burner as claimed in claim 2 including fuel and oxygen injection means for injecting the fuel and oxygen into the combustion chamber at a velocity ratio of substantially 2:1.

11. The oxygen-fuel burner as claimed in claim 2 further comprising means for discharging air from the outlet end in the direction of combustion flame discharge.

12. The oxygen-fuel burner as claimed in claim 11 wherein the air discharge means comprises a plurality of air outlets circumferentially spaced around the oxygen outlets.

13. The oxygen-fuel burner as claimed in claim 12 wherein the air outlets are angled radially inwards relative to axis X.

14. The oxygen-fuel burner as claimed in claim 12 wherein the air outlets are skewed relative to axis X.

15. The oxygen-fuel burner as claimed in claim 14 wherein the air outlets are skewed about axis X in the same direction as the oxygen outlets.

16. The oxygen-fuel burner as claimed in claim 2 in which the fuel outlet comprises one of a fuel oil outlet and fuel gas outlet.

* * * * *